United States Patent [19]

Seib et al.

[11] Patent Number: 4,669,380

[45] Date of Patent: Jun. 2, 1987

[54] SAFETY DEVICE FOR A SHEET-FED ROTARY PRESS

[75] Inventors: Berthold Seib, Bodbau; Helmut Emrich, Offenbach am Main, both of Fed. Rep. of Germany

[73] Assignee: M.A.N.-Roland Druckmaschinen Aktiengesellschaft, Fed. Rep. of Germany

[21] Appl. No.: 798,748

[22] Filed: Nov. 15, 1985

[30] Foreign Application Priority Data

Nov. 16, 1984 [DE] Fed. Rep. of Germany ..... 3441963

[51] Int. Cl.[4] ..... B41F 1/64

[52] U.S. Cl. ..... 101/216

[58] Field of Search ..... 101/212, 216, 174, 178, 101/136, 141, 142, 144, 145, 182, 185, 247, 152, 153, 116, 132; 100/53

[56] References Cited

U.S. PATENT DOCUMENTS

| | | | |
|---|---|---|---|
| 2,366,930 | 1/1945 | Pirie | 101/216 X |
| 3,498,217 | 3/1970 | Kletti | 101/216 |
| 4,454,812 | 6/1984 | Johne et al. | 101/216 |
| 4,530,283 | 7/1985 | Mathes et al. | 101/230 |

*Primary Examiner*—J. Reed Fisher

*Attorney, Agent, or Firm*—Leydig, Voit & Mayer

[57] ABSTRACT

A safety device has pivotally mounted rails for guarding impression cylinder nips in a sheet-fed rotary printing press. The guard rails are pivoted from a guard or safety position during maintenance to a second position away from the impression cylinder during printing to insure that the printed sheets are not smeared by the edges of the guard rails. The guard rails, however, also sense operator contact during maintenance to cause the inching drive of the press to shut off immediately. A hinged access cover or door on the press shields the impression cylinder and cooperating cylinder during printing, and is opened to perform maintenance. Opening of the access cover operates an electrical switch for shutting off the main drive of the press, and the access cover is mechanically connected to the guard rails by a resilient linkage which in turn causes pivoting of the guard rails toward their safety positions. A second electrical switch is operated by the pivoting of the guard rails and shuts off the inching drive in response to operator contact and pivoting of the guard rails in either direction from their safety positions. The resilient linkage also includes abutments limiting the range of pivoting due to operator contact.

17 Claims, 4 Drawing Figures

SAFETY DEVICE FOR A SHEET-FED ROTARY PRESS

BACKGROUND OF THE INVENTION

1. Field of the Invention

The present invention relates generally to a safety device for a rotary press, and more particularly to a safety device for guarding a roller nip in a sheet-fed rotary press.

2. Description of the Background Art

A safety device for guarding a roller nip in a sheet-fed rotary press is disclosed in West German patent No. 2,914,152. The safety device includes two separate guard plates that are pivotally interconnected by a hinge. A first one of the guard plates is disposed at the roller nip from which the fed sheet issues. When the safety device is in its "normal" position used during printing, both of the guard plates serve as a sheet guide, and the first guard plate is pivoted out of its guard or safety position at the roller nip. This ensures that the trailing end of the printed sheet is not smeared on the edge of the first guard plate during continuous printing which could occur when the rotary press is fed with heavy sheets or board which tend to "set-off" from the impression cylinder. To wash the impression cylinder, the first guard plate is moved into its safety position by first moving the second guard plate away from the roller nip to give access to the impression cylinder. When this is done a lever operates a switch to prevent the printing press from being started. A disadvantage with this particular safety device is that the "inching" drive to the printing press is not stopped electrically when the first guard plate at the roller nip is contacted, which presents a safety hazard when the impression cylinder is washed by hand. Also in the safety position the press drive can operate only in a "backwards" inching mode since during the washing of the impression cylinder a second roller nip in the printing unit is exposed and would tend to grab a person's hand if the press drive were operated in a "forward" inching mode. During washing of the impression cylinder, the second roller nip becomes exposed because the second guard plate must be moved from the second roller nip to give access to the impression cylinder.

Many other devices for guarding the entry of the roller nip are known, for example, from West German patent Nos. 766,210; 1,165,044; 1,561,070; and 1,611,238; and French patent Nos. 833,280; and 1,579,086. These safety devices secure the entry side of a roller nip when the press stops, when the safety device is contacted or when access to the roller nip is reduced or impeded by resilient plates acting oppositely to the entry direction. However, unsmeared printing sheets cannot always be delivered from the exit of the roller nip since the guards cannot be pivoted out of the path of the sheet during printing as well as pivoted by the operator during servicing or adjustment.

SUMMARY OF THE INVENTION

In view of the above, the primary object of the invention is to provide a safety device for guarding the roller nips a sheet-fed rotary printing press, the safety device having guards which are pivoted from a guard or safety position during maintenance to a second position during printing to insure that the printed sheets do not smear, but wherein the guards also respond to operator contact by immediately shutting off the inching drive.

Another object of the invention is to insure that both of the roller nips adjoining the impression cylinder in a five-cylinder press are guarded during washing of the impression cylinder so that both forward and reverse inching of the impression cylinder may be performed at this time.

By using the safety device of the present invention, access to the impression cylinder for washing is unimpeded and safety at the roller nips is increased, without risk of the printed sheets being smeared on the edges of the guard plates during printing. Nor does the inching drive need to be shutt off during maintenance and ease of servicing is improved when working simultaneously on a number of cylinders.

BRIEF DESCRIPTION OF THE DRAWINGS

Other object and advantages of the invention will become apparent upon reading the following detailed description and upon reference to the drawings, in which.

Figure 1:
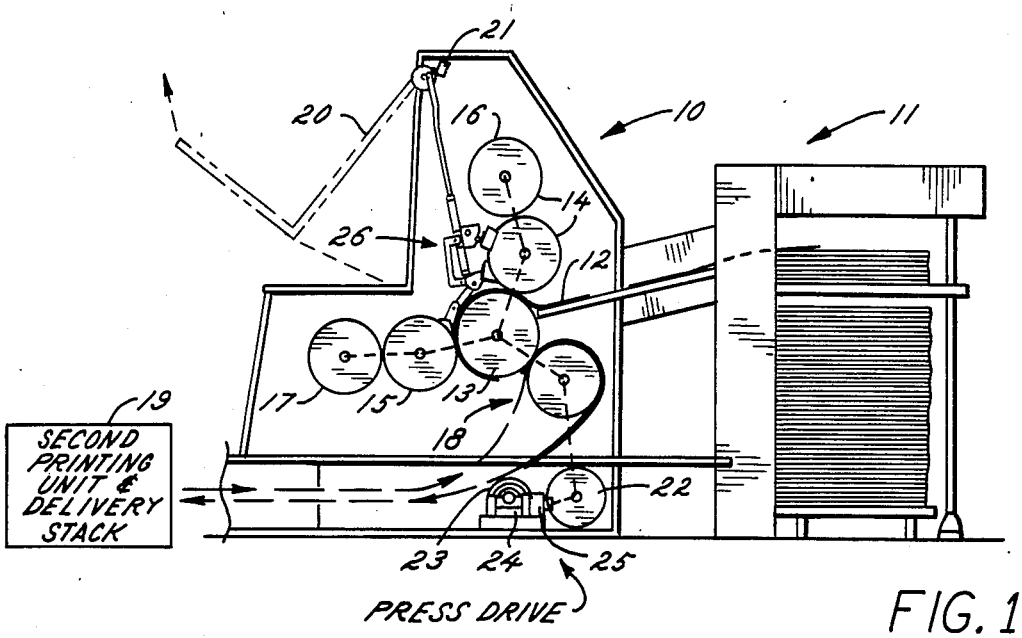
FIG. 1 is a schematic diagram of a sheet-fed five-cylinder rotary offset printing press employing a safety device according to the present invention.

While the invention is susceptible to various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents and alternatives falling within the spirit and scope of the invention as defined by the appended claims.

DETAILED DESCRIPTION OF A PREFERRED EMBODIMENT

Returning now to the drawings, there is shown in FIG. 1 a five cylinder rotary offset printing unit generally designated 10 receiving individual sheets fed by a sheet feeder 11. In order to print two different colors of ink on a sheet 12, the sheet 12 passes through a first nip formed between an impression cylinder 13 and an upper blanket cylinder 14, and then is carried by the impression cylinder 13 through a second nip formed between the impression cylinder 13 and a lower blanket cylinder 15. The upper blanket cylinder 14 receives ink of a first color from an upper plate cylinder 16, and transfers the first color ink to the sheet 12. Similarly, to print ink of a second color, the lower blanket cylinder 15 receives ink of the second color from a lower plate cylinder 17, and transfers the second color ink to the sheet 12. After receiving the two colors of ink, the sheet 12 is picked up by a conveyer generally designated 18 and is conveyed to a second printing unit and delivery stack 19 in order to provide four-color printing. By using three primary colors and black ink, a full range of colors may be printed on the sheets.

Before printing occurs, the plate cylinders 16, 17 must be fitted with lithographic plates defining the printing areas for the two respective colors. Also, the blanket cylinders 14, 15 are fitted with rubber blankets suitable for transferring the ink from the plate cylinders 16, 17 to the impression cylinder 13. Between printing runs, the impression cylinder 13 must be washed to remove ink having built up on the surface on the cylinder.

In order to perform the above described maintenance upon the cylinders 13–17, the printing unit 10 has a rear access cover or door 20 which is hinged at the top portion of the printing 10. To prevent the cylinders 13–17 and other moving parts of the printing unit 10 from causing bodily injury to maintenance personnel, the door 20 operates an electrical switch 21 so that opening of the door 20 opens the electrical circuit feeding power to the main drive motor 22 which rotates the cylinders 13–17 during printing. For adjustment of the cylinders, however, it is still necessary to allow the maintenance personnel to rotate the cylinders, but the rotation can be performed at a relatively slow speed under direct manual control. For this purpose an "inching" control is provided which activates a second drive motor 23 having speed reducing gears 24. In order to prevent this inching drive motor 23 from interfering with the main drive motor 22 during printing, the output of the reduction gear box 24 is coupled to the main drive motor 22 through an electric clutch 25.

Even though the cylinders are rotated by the inching drive at a relatively slow speed, there is still a great potential for bodily injury at the nips between the cylinders due to the tendency of hands or fingers to be grabbed from the entry side of the nips and to be squeezed by the cylinders. Because the cylinders have a relatively large diameter in comparison to the width of a person's hand or finger, a considerable amount of pressure could be applied to the hand or finger. To prevent a maintenance person from accidentally placing his hands or fingers into the entry portions of the nips, printing units have been provided with guard plates which cover the nips. These known arrangement of guard plates, however, have not provided a particularly high degree of safety or else have interfered with the printing of particularly heavy sheets 12, such as boards. Frequently the trailing end portions of boards have become set-off of the impression cylinder 13 during continuous printing and have struck the edges of the guard plates, thereby causing a smearing of the ink having been printed on the boards.

In accordance with a primary aspect of the present invention, the printing unit 10 is provided with a nip guard mechanism generally designated 26 which is mechanically operated by the opening and closing of the access cover or door 20. In particular, the smear-free printing of heavy sheet or board is insured by pivoting the guard plates away from the impression cylinder 13 when the access cover or door 20 is closed.

Figure 2:
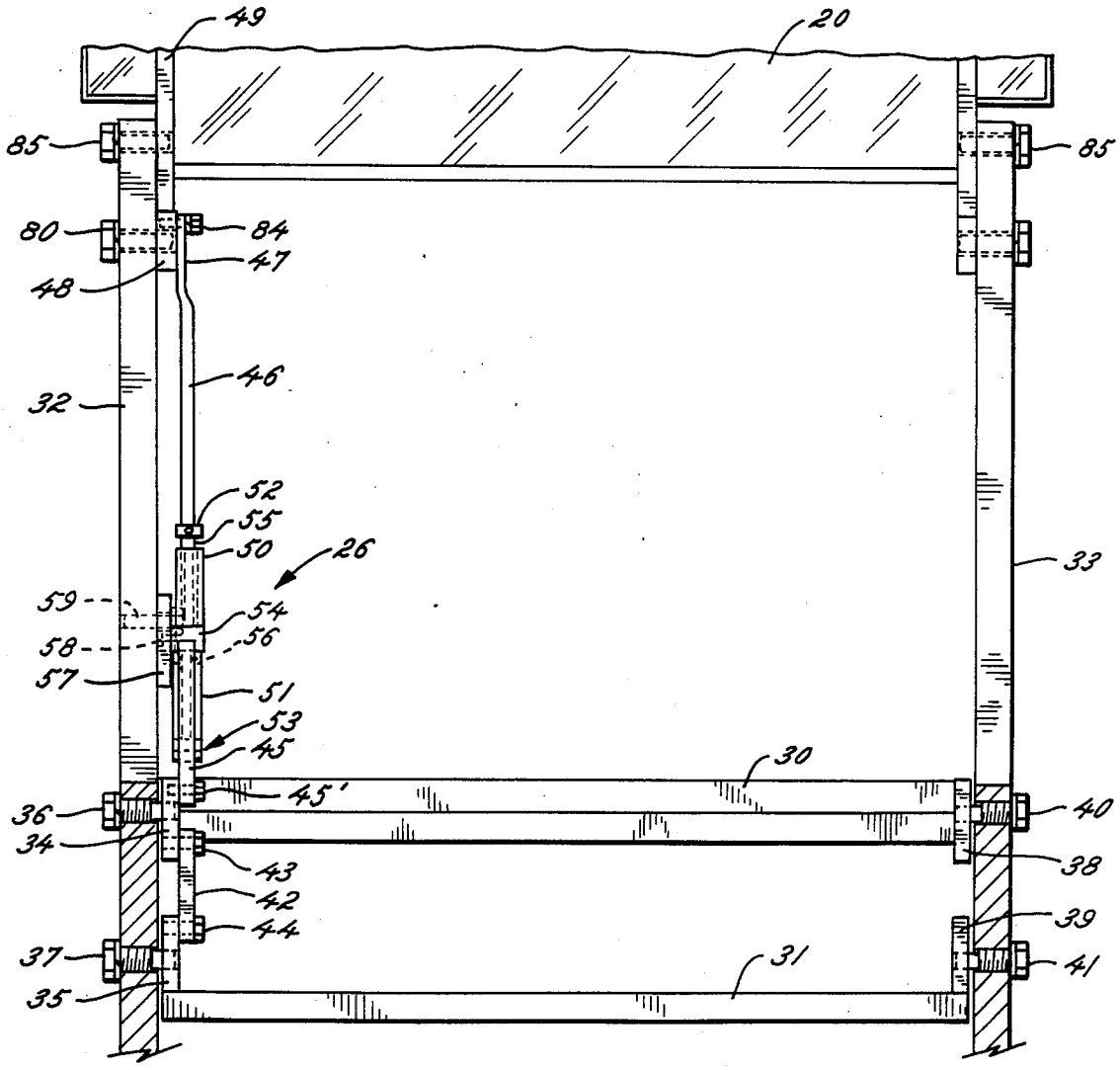
FIG. 2 is an elevation view of the safety device shown in FIG. 1 viewed from the rear of the printing unit.
Figure 3:
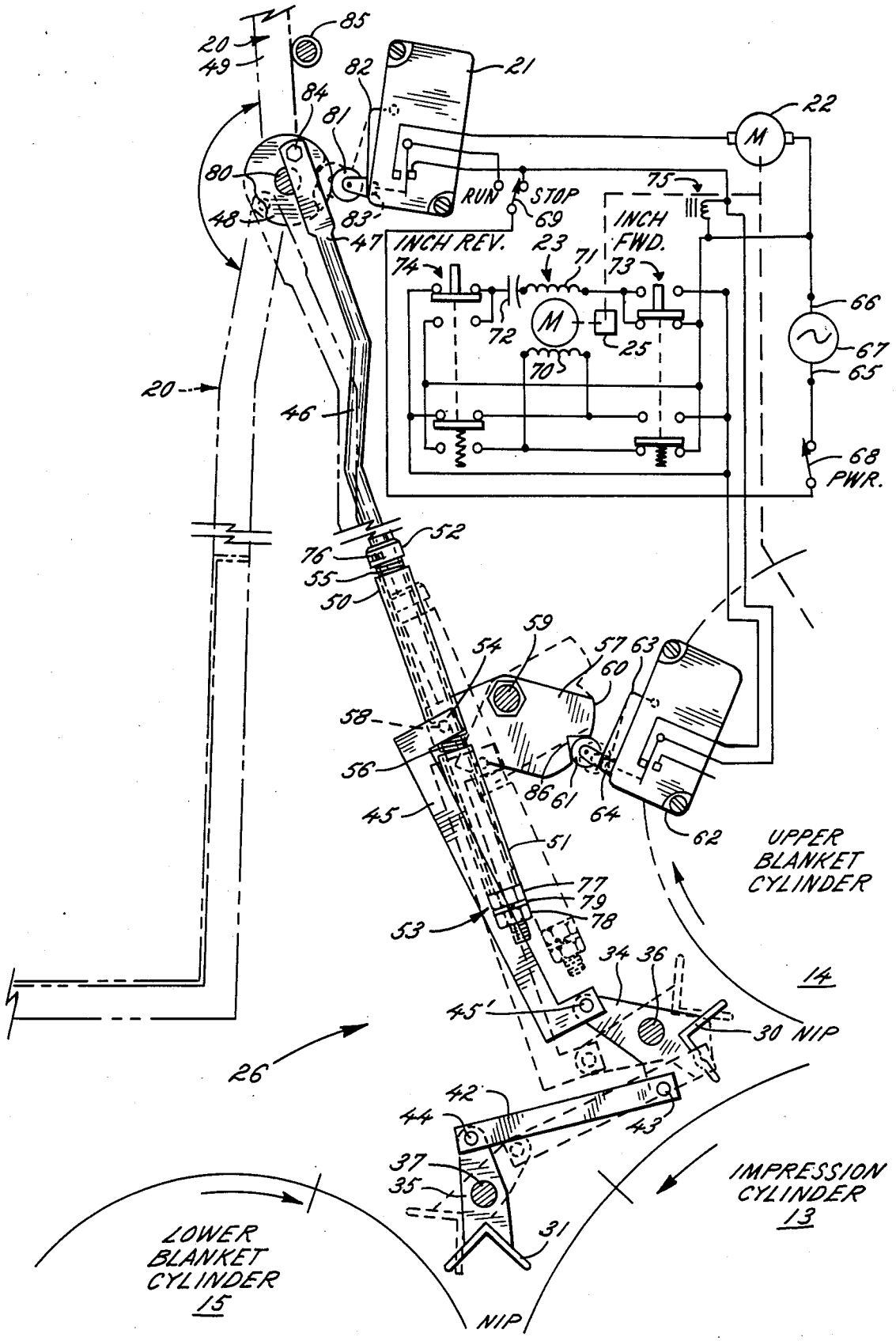
FIG. 3 is a side view of the safety device with the safety position for maintenance being shown in solid lines and the second position for printing being shown in phantom lines.

Turning now to FIGS. 2 and 3, the safety device 26 is shown in greater detail. To guard the danger zones about the nips between the impression cylinder 13 and the blanket cylinders 14, 15, the danger zones are shielded or covered by L-shaped guard rails 30, 31 which extend parallel to the axes of the cylinders 13–15. Although they are not shown in FIG. 2, the cylinders 13–15 are journaled to the side walls 32, 33 of the press frame. In order to move the guard plates 30, 31 away from the impression cylinder 13 when the door 20 is closed as shown in phantom lines in FIG. 3, the guard rails 30, 31 are pivotally mounted to the side frames 32, 33 of the printing unit (See FIG. 2) and the guard rails are mechanically linked to the door 20. Each guard plate 30, 31 is mounted to respective pivoted levers 34, 35 mounted on respective pivots 36, 37 fastened to the side walls 32, 33 of the press frame. As shown in FIG. 2 the pivots 36, 37 are provided by bolts having cylindrical end portions. As also shown in FIG. 2, the linkages for the safety device 26 are provided on the left-hand side of the printing unit. The guard rails 30, 31 are also pivoted to the right-hand side frame 33 by similar pivoted levers 38, 39 mounted in similar pivots 40, 41 secured to the right-hand side wall. The guard rails 30, 31 are, for example, welded at their ends to the pivoted levers 34, 38 and 35, 39. During assembly, the guard rails having been welded are inserted between the side frames 32, 33 and the pivot bolts 37, 38, 40, 41 are assembled from outside of the press frame. So that the two guards rails 30, 31 are pivoted in unison, they are joined by a connecting rod 42 which is connected at its respective ends to the levers 34, 35 by respective bolts 43, 44. For the sake of illustration, in FIG. 3 and FIG. 4 the stationary pivots secured to the press frame have been cross-hatched.

Although the opening and closing of the door 20 causes the guard rails 30, 31 to pivot, it is also desirable to allow maintenance personnel to pivot the guard rails 30, 31 to a limited extent from their guard or safety positions. For this purpose the lever 34 is connected to the door 20 via a two part linkage including a C-shaped connecting rod 45 and a cylindrical actuating rod 46 which passes through a bore in the upper portion 54 of the C-shaped actuating rod. A flatened end portion 47 of the cylindrical connecting rod 46 is pivotally secured to a hinging portion 48 of a side frame 49 of the door 20. The lower end portion of the C-shaped connecting rod 47 is pivotally secured to the lever 34 by a bolt 45. The guard rails 30, 31 may pivot even though the access cover 20 is held stationary due to sliding of the C-shapped connecting rod with respect to the actuating rod 46. The pivoting of the guard rails 30, 31 is limited by tubular spacers 50, 51 mounted coaxially on the lower portion of the cylindrical actuating rod 46, and by abutments 52, 53 secured to the cylindrical connecting rod between the spacers 50, 51. The upper end portion 54 of the C-shaped connecting rod 51 is retained between the spacers 50, 51. Moreover, to define central safety positions of the guard rails 30, 31 when the guard rails are not contacted by a maintenance person, respective compression springs 55, 56 are mounted coaxially on the cylindrical actuating rod 46 and are received within the tubular spacers 50 and 51. The compression springs 55, 56 press against the upper portion 54 of the C-shaped connecting rod 45 and against their respective abutments 52, 53.

In order to enhance the stability of the linkage, the upper end portion 54 of the C-shaped connecting rod 45 is also pivotally mounted to the left side frame 32. The upper end portion 54 is pivoted to a lever 57 by an internal pivot screw 58 and the lever 57 is in turn pivoted to the left-hand side frame via a pivot bolt 59.

For safety, the inching motor 23 is shut off unless the guard rails 30, 31 are either in their printing positions, shown in phantom lines in FIG. 3, or in their safety or guard positions, shown in solid lines in FIG. 3. For this purpose the pivoted lever 57 is formed with a cam segment 60 engaging the roller 61 of a switch 62. The switch 62 is mounted on and screwed to the inside surface of the left side frame 32. The switch 62 is of conventional construction and has a pivoted actuating lever 63 to which the roller 61 is journaled and which rests upon a tappet or abutment 64 of the switch 62. The switch 62 is wired in a series circuit to the inching motor 23. This circuit runs from the power lines 65, 66 of the electrical utility system 67 and includes a main power switch 68 as well as a run-stop switch 69. The run-stop switch 69 directs power to either the main drive motor 22 when the run-stop switch is in its "run" position or to the inching motor 23 when the switch is in its "stop" position.

As shown in FIG. 3, the inching motor 23 is an AC motor having its direction reversed by reversal of the relative phase or polarity between its main field winding 70 and its second phase winding 71 which is in series with a starting capacitor 72. The inching motor windings 70, 71 are selectively excited by an inch forward push button switch 73 (shown depressed) and an inch reverse push button switch 74. The switches 73, 74 are electrically interlocked to prevent the inching motor 23 from being activated and to prevent short circuits in the event that both of the inching push-button switches 73, 74 are simultaneously depressed. The electromagnet 75 of the clutch 25 is energized when the main drive motor 22 is stopped, and therefore also functions as a safety brake.

In order to insure that the safety positions of the guard rails, 30, 31 are reached when the access cover or door is fully opened, the abutments 52, 53 are adjustable. The upper abutment 52 is secured at a selected location by a set screw 76 or other fastener such as a cotter pin. Then the lower abutment 53 is adjustable over a certain range until the safety position is reached, as indicated by closure of the switch 62. At this point the lower abutment is locked into position. For this purpose, the lower abutment 53 consists of a pair of nuts 77, 78 threaded to the lower end portion of the actuating rod 46 separated by a lock washer 79. The nuts 77, 78 are jammed together once the proper adjustment is obtained.

To disable the main drive motor 22 when the access cover 20 is opened, the hinge portion 48 of the cover 20 is in the form of a cam disc journaled to a hinge pin 80. The outer surface of the disc 48 is engaged by a roller 81 which is part of the interlock or switch 21 controlling the main drive motor 22. The switch 21 is conventional and includes a pivoted lever 82 to which the roller 81 is journaled and which acts upon a tappet or button 83 of the switch. The switch 21 is mounted and screwed to the inside surface of the left side frame 32. To prevent interference between the hinge pin 80 and the upper end portion 47 of the actuating rode 46, the hinge pin 80 is in the form of a bolt assembled from outside of the side frame 32, and the upper end portion 47 of the connecting rod is connected to the disc 48 by a pivot bolt 84.

To wash the cylinders and more particularly the impression cylinder 13, the access cover or door is raised to its upper most position which is defined by stops 85 secured to the side frames 32, 33 (see FIG. 2). Raising of the cover opens the switch 21 thereby inhibiting the main drive motor 22. When the access cover or door 20 reaches its upper most position, the guard rails 30, 31 have moved from their printing positions (shown in phantom lines in FIG. 3) to their guard positions (shown in solid lines in FIG. 3). At this point the roller 61 of the switch 62 drops into a grove 86 formed in the cam surface 60 of the pivoted lever 57, so that the inching motor 23 is enabled and can be operated by the inching push buttons 73, 74.

Figure 4:
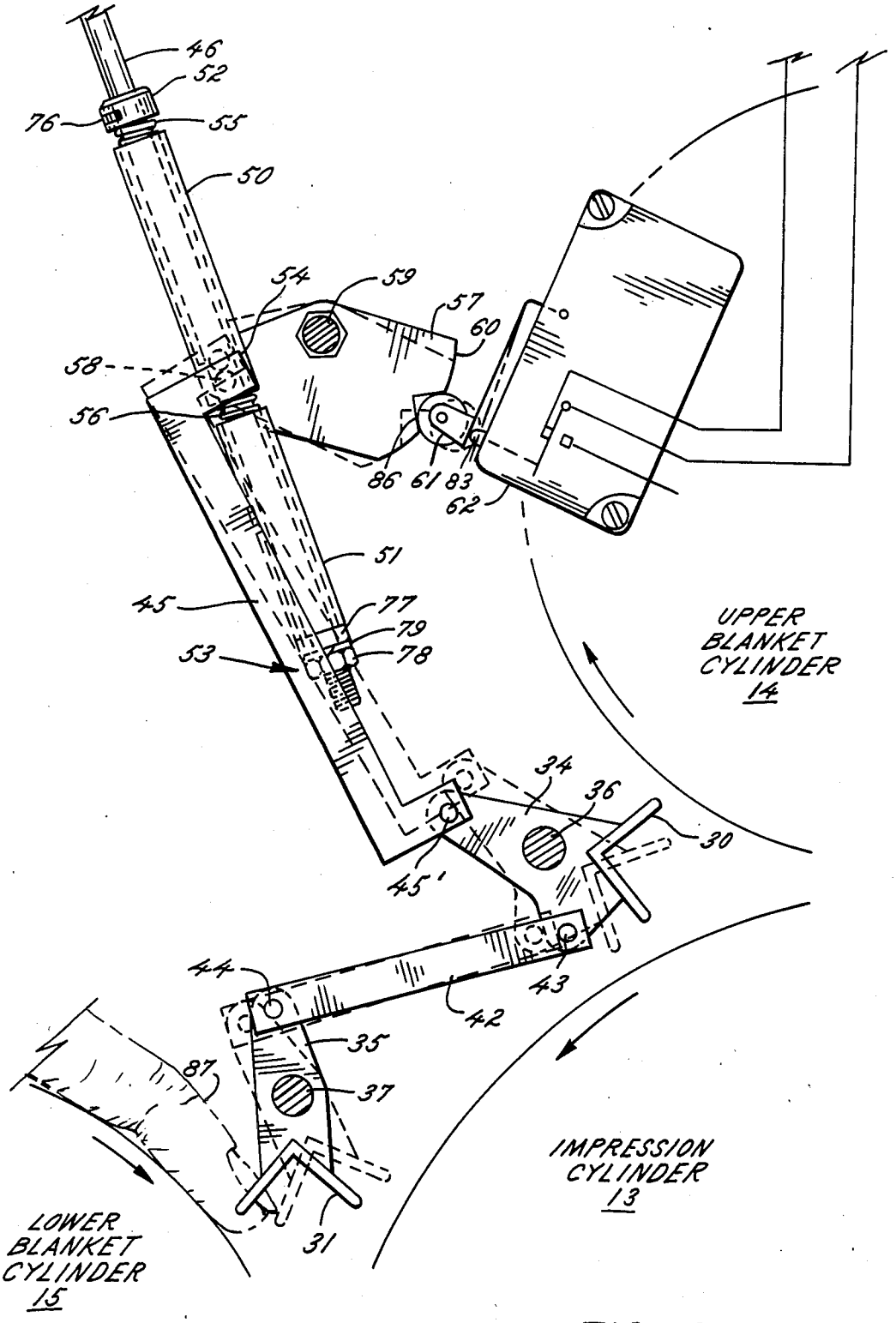
FIG. 4 is a side view of the safety device with the safety position for maintenance being shown in solid lines and a guard position resulting from operator contact being shown in phantom lines.

Washing of the impression cylinder 13 is illustrated in FIG. 4. If during washing of the impression cylinder 13 the maintenance person's hand or finger 87 moves near either of the two nips between the impression cylinders and the upper or lower blanket cylinders 14, 15 and knocks or contacts either one of the guard rails 30, 31, the guard rails 30, 31 pivot slightly from their guard or safety positions causing the switch 62 to open and disable the inching motor 23. The arrows in FIG. 4 indicate the forward inching direction, which would, for example, tend to push the maintenance person's finger 87 against the lower guard plate 31. The springs 55, 56 offer some resistance to movement as the inching motor 23 is shut off. Moreover, the deflection of the guard rails 30, 31 from their safety or guard positions is limited by the upper portion 54 of the C-shaped linkage 45 abutting against the spacers 50, 51. When the hand or finger 87 is removed, the springs 55, 56 return the guard rails 30, 31 to the their guard or safety positions.

When the access cover or door 20 is closed upon completion of washing or other maintenance, the guard rails 30, 31 return from their safety or guard positions to their printing positions thereby insuring smear-free printed sheets, and the switches 21, 62 close to permit activation of the main drive motor 22 for printing.

What is claimed is:

1. In a sheet-fed rotary printing press of the kind having an impression cylinder carrying the fed sheets and a second cylinder engaging said impression cylinder at a nip, the cylinders being rotated by a press drive during printing and during maintenance, a safety device comprising a guard which is moveable from a predefined safety position shielding said nip, and means for stopping the press drive in response to the guard being contacted by a maintenance person, wherein said printing press has an access cover which is closed during continuous printing to cover said cylinders and is open during maintenance to permit access to said cylinders, and wherein said safety device includes means responsive to the opening and closing of said access cover to move said guard away from said impression cylinder and away from said safety position to a predefined second position when said access cover is closed and to return said guard to said safety position when said access cover is open.

2. The safety device as claimed in claimed 1, wherein the printing press includes side frames to which said cylinders are journaled, and wherein said guard is an L-shaped rail extending parallel to the cylinders and being pivotally mounted to said side frames for movement about said safety position.

3. The safety device as claimed in claim 1, wherein said access cover has a hinge for opening and closing, and said means responsive to said opening and closing includes a mechanical linkage connecting said access cover to said guard.

4. The safety device as claimed in claim 3, wherein said hinge includes a cam disc attached to said access cover, said cam disc operating a switch for enabling said press drive for printing when said access cover is closed and disabling said press drive for printing when said access cover is open, and wherein said linkage includes an actuating rod pivotally connected to said cam disc.

5. The safety device as claimed in claim 1, wherein said means responsive to said opening and closing includes a mechanical linkage connecting said access cover to said guard, and wherein said mechanical linkage includes a resilient element which retains said guard in said safety position when said access cover is opened, and abutments which limit movement of said guard to within a predefined range about said safety position.

6. The safety device as claimed in claim 5, wherein said safety position is a central position within said predefined range.

7. In a sheet-fed rotary printing press of the kind having an impression cylinder carrying the fed sheets and a second cylinder engaging said impression cylinder at a nip, said cylinders being rotated at a first speed by a press drive during printing and being selectively rotated by the press drive at a second reduced speed during maintenance, a safety device comprising a guard which is movable from a predefined safety position shielding said nip, a first mechanically operated electrical switch for preventing said press drive from rotating said cylinders at said first speed during maintenance, a second mechanically operated switch for preventing said press drive from rotating said cylinders at said reduced second speed during maintenance in response to said guard being contacted by a maintenance person and moved from said safety position, a mechanical linkage connecting said first mechanically operated electrical switch and said second mechanically operated electrical switch and said guard, said mechanical linkage being actuated at the end of maintenance to move said guard in a direction away from said impression cylinder and away from said safety position to a predefined second position operating said first electrical switch to enable said press drive for printing, and being actuated at the end of printing and the beginning of maintenance to return said guard to said safety position, thereby insuring both the smear-free printing of the fed sheets and the safety of the maintenance person.

8. The safety device as claimed in claim 7, wherein the printing press includes side frames to which said cylinders are journaled, and wherein said guard is an L-shaped rail extending parallel to the cylinders and being pivotally mounted to said side frames for movement about said safety position.

9. The safety device as claimed in claim 7, wherein said printing press has an access cover provided with a hinge for opening to perform maintenance and closing to perform printing, and said mechanical linkage is connected to said cover for said actuation upon the opening and closing of said access cover.

10. The safety device as claimed in claim 9, wherein said hinge includes a cam disc attached to said access cover, said cam disc operating said first mechanically operated electrical switch, and wherein said linkage includes a rod pivotally connected to said cam disc for said actuation of said linkage.

11. The safety device as claimed in claim 7, wherein said mechanical linkage includes a resilient element disposed between said first mechanically operated electrical switch and said second mechanically operated electrical switch, said resilient element retaining said guard in said safety position during maintenance, and wherein said linkage has abutments which limit movement of said guard during maintenance to within a predefined range about said safety position.

12. The safety device as claimed in claim 11, wherein said safety position is a central position within said predefined range.

13. In a five cylinder sheet-fed rotary printing press of a kind having an impression cylinder carrying the fed sheets and second and third cylinders each engaging said impression cylinder, said cylinders being journaled to a press frame, and a press drive for rotating said cylinders at a first speed during printing and selectively rotating said cylinders in a forward and reverse direction at a reduced second speed during maintenance, a safety device comprising first and second guard rails pivotally mounted at their ends to the press frame and disposed near respective ones of the two nips between the impression cylinder and the second and third cylinders, each guard rail being moveable from a respective predefined safety position shielding its respective nip, and means for stopping the press drive in response to either of the guard rails being moved from its respective safety position, wherein said printing press has an access cover which is closed during continuous printing to shield said impression cylinder and is open during maintenance to gain access to said impression cylinder, a first mechanically operated electrical switch operated by the opening and closing of said access cover to enable said press drive for rotating said cylinders at said first speed during printing and to disable said press drive from rotating said cylinders at said first speed during maintenance, said first mechanically operated electrical switch being mechanically operated by the opening and closing of said access cover, a second mechanically operated electrical switch for preventing said press drive from rotating said cylinders at said reduced second speed during maintenance in response to either of said guard rails being contacted by a maintenance person and moved from its respective safety position, and a linkage including a resilient element and abutments limiting the degree of extension and contraction of said resilient element for mechanically connecting said access cover and first mechanically operated electrical switch to said guard rails and said second mechanically operated electrical switch for moving said guard plates away from their respective safety positions in a direction away from said impression cylinder to respective second predefined positions when said access cover is closed, and to return said guard plates to their respective safety positions when said access cover is open, to thereby insure both the smear-free printing of the fed sheets and the safety of the maintenance person.

14. The safety device as claimed in claim 13, wherein each of said guard rails has an L-shaped cross-section.

15. The safety device as claimed in claim 13, wherein said access cover is connected to said press frame via a hinge, said hinge includes a cam disc attached to said access cover, said cam disc operates said first mechanically operated electrical switch, and wherein said linkage includes an actuating rod pivotally connected to said cam disc.

16. The safety device as claimed in claim 15, wherein said resilient element comprises a pair of springs coaxially mounted on said actuating rod between two abutments secured to said rod, a tubular element enclosing each spring, and a connecting rod threaded with said actuating rod and disposed between said springs and said tubular elements, thereby limiting movement of said guard rails caused by contact of said maintenance person to within predefined ranges about their safety positions.

17. The safety device as claimed in claim 16, wherein the respective safety positions are central positions within their respective predefined ranges of movement.

* * * * *